US005309835A

United States Patent [19]

Hartung et al.

[11] Patent Number: 5,309,835

[45] Date of Patent: May 10, 1994

[54] DEVICE FOR DRAWING AND BENDING PRINTING PLATES

[75] Inventors: Georg Hartung, Seligenstadt; Helmut Schild, Steinbach/Taunus; Manfred Herold, Offenbach Main, all of Fed. Rep. of Germany

[73] Assignee: MAN Roland Druckmaschinen AG, Fed. Rep. of Germany

[21] Appl. No.: 56,026

[22] Filed: Apr. 30, 1993

[30] Foreign Application Priority Data

Apr. 30, 1992 [DE] Fed. Rep. of Germany ..... 4214207

[51] Int. Cl.[5] ..... B41F 1/28

[52] U.S. Cl. ..... 101/415.1; 101/477

[58] Field of Search ..... 101/415.1, 477

[56] References Cited

U.S. PATENT DOCUMENTS 5,094,165 3/1992 Sugiyama et al. ..... 101/415.1

5,127,328 7/1992 Wieland ..... 101/415.1

5,218,907 6/1969 Komorl et al. ..... 101/415.1

*Primary Examiner*—Eugene H. Eickholt

*Attorney, Agent, or Firm*—Leydig, Voit & Mayer

[57] ABSTRACT

A device for drawing and bending the trailing edge of a printing plate onto a plate cylinder of a printing machine such as a sheet-fed rotary printing press, in which a pressure roller with an attached actuatable folding strip draws a printing plate, which has its leading print edge fastened into a tension rail, around the outer circumference of the plate cylinder as the plate cylinder is rotated, to a position where the folding strip is actuated thereby introducing the trailing edge of the printing plate into a second tension rail. The device provides a means for drawing the printing plate onto the printing cylinder with a desirable uniform tension and without requiring auxiliary devices for pre-folding the printing plate in order to secure the trailing printing plate edge into a tension rail.

12 Claims, 6 Drawing Sheets

DEVICE FOR DRAWING AND BENDING PRINTING PLATES

FIELD OF THE INVENTION

This invention relates generally to printing presses and more particularly to a device for drawing printing plates onto the plate cylinder of printing machines such as sheet-fed rotary printing presses.

BACKGROUND OF THE INVENTION

In sheet-fed offset printing machines, a printing plate is drawn on around a printing plate cylinder by means of two tension rails arranged in the elongated cylinder channel. One tension rail is assigned to the leading edge of the printing plate (the print start) and the other is assigned to the trailing edge of the printing plate (the print end). Once the tension rails are clamped into position, external mechanisms tension the printing plate to the desired level. For this drawing-on operation, the plate cylinder is first rotated into a position in which the tension rail assigned to the leading edge is easily accessible such that the printing plate's leading edge can be introduced into the tension rail. After the leading print edge has been clamped, the plate cylinder is slowly rotated until the printing plate is wrapped around the plate cylinder and the trailing edge of the printing plate can be easily introduced into the print-end tension rail. It is of great importance to the success of the printing plate loading process that the leading print-start edge of the printing plate is exactly aligned with the printing plate and that the printing plate has been drawn on with a uniform tension. Any non-uniformities in the drawing-on moment over the format width must be corrected by a costly readjustment process.

Systems for automatically changing a printing plate, in which a new printing plate is fed and drawn onto the plate cylinder automatically, are known from DE 3,940,795 C2, DE 3,940,796 C2 and EP 0,431,575 A2. These systems also have, in addition to storage and reception regions for the printing plates, transport apparatuses for introducing new printing plates onto the print cylinder. These plate changing systems utilize pressure rollers which can be positioned against the outer circumference of the plate cylinder or positioned away from the plate cylinder. Once the pressure roller is engaged to the plate cylinder, the trailing print edge of the printing plate may be introduced into the corresponding tension rail. In the disclosure of EP 0,431,575 A2 the pressure roller is arranged on the pivotable end of a printing-plate magazine which can be set against the plate cylinder and, therefore, by reason of the lever relations recognizable in this publication, this pressure roller cannot exert a high contact pressure drawing-on force onto the outer circumference of the plate cylinder. EP 0,431,575 A2 further requires a pressure roller merely for introducing the folded print end of the printing plate into the tension rail.

The pressure roller suggested in the two German Patent Specifications, DE 3,940,795 C2 and DE 3,940,796 C2, serves to advance the non-folded end of the printing plate onto an open tension rail to facilitate a clamping operation. However, as illustrated in FIG. 3 of both publications, in order for the pressure roller to press the printing plate against the plate cylinder, the plate cylinder has to be moved relative to the pressure roller. This operation situates the pressure roller so that the roller can only partially and incompletely press the printing plate against the plate cylinder. The tightening torque previously obtained on the printing plate during the forward rotation of the plate cylinder in the course of the drawing-on operation can consequently be reduced in this phase.

OBJECTS OF THE INVENTION

It is a general object of the invention to provide an improved device for drawing printing plates onto the plate cylinder of printing machines. More specifically, it is an object of the invention to provide a device for drawing printing plates onto the plate cylinder of printing machines wherein it is possible to draw on and insert non-folded printing plates into a print-end tension rail with a high drawing-on moment.

SUMMARY OF THE INVENTION

The present invention accomplishes these objectives and overcomes the drawbacks of the prior art by providing an actuatable folding strip assigned to a positional pressure roller for assisting the insertion of the trailing edge of a printing plate into the print end tension rail. During the slow forward rotation of the plate cylinder while a new printing plate is being drawn on, the pressure roller, which is selectively engaged to the plate cylinder, presses the printing plate onto the outer circumference of the plate cylinder. The printing cylinder is then rotated until the printing plate has been drawn onto the plate cylinder up to the region of the print end of the plate cylinder. Subsequently, the folding strip is actuated causing the trailing edge of the printing plate to bend around the print end beveled entrance portion of the plate cylinder and travel up to a stop on the rear tension rail over the entire format width of the plate cylinder. The trailing edge of a printing plate can now be clamped by the open tension rail, for example, by closing an open clamping flap through the forward movement of a circumferentially adjustable tension rail or through the forward pivoting of a correspondingly mounted tension rail.

This operation of drawing on a new printing plate takes place while the rubber-blanket cylinder of the printing press is set off from the plate cylinder. The entire drawing-on moment for the new printing plate is thus generated solely by the pressure roller which, for example, has a rubber covering.

Thus, a folding of the printing plate during the drawing-on operation takes place by means of the actuatable folding strip which extends in a parallel fashion, over the format width of the printing plate and pressure roller. A new printing plate therefore does not have to be folded by a special device before being drawn on. Since the folding of the printing plate takes place on the plate cylinder, exact conformity to the existing conditions of the circumferential width of the plate cylinder is ensured. Further, previously used printing plates can be drawn on by the device without difficulty.

In accordance with another aspect of the invention, the apparatus for drawing printing plates onto the plate cylinder of printing machines can be employed both in fully automatic printing-plate changing systems and in semi-automatic devices for changing printing plates. In devices of the latter type, no storage chambers and conveying devices are provided for the new and old printing plates, but these operations are carried out by hand. In devices of this kind, only the opening and closing of the tension rails, the tensioning of the printing plate via the print-end tension rail and the corresponding operations for positioning the plate cylinder can be executed automatically.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 2:
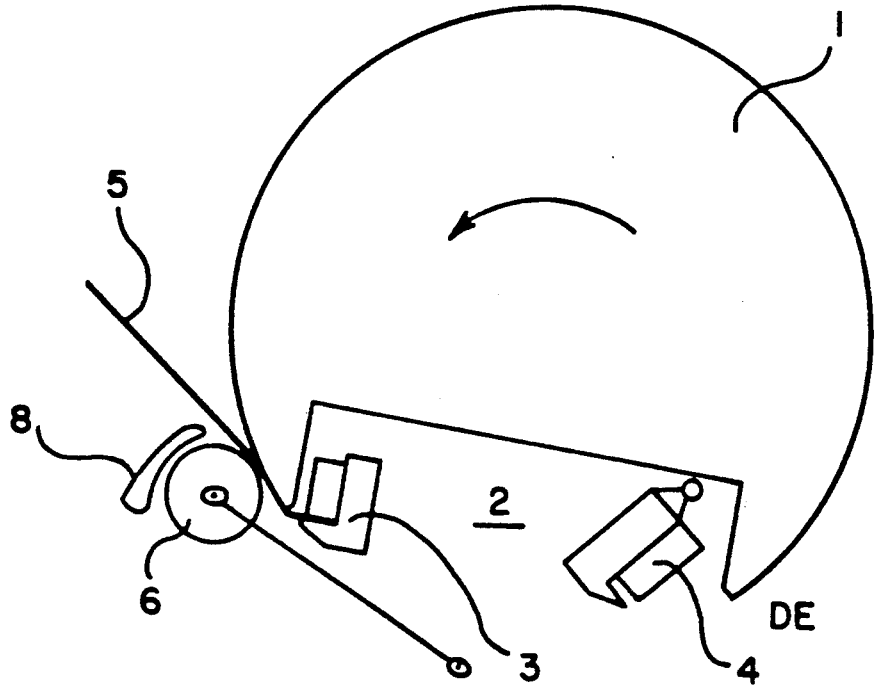
FIG. 2 is a schematic illustration similar to FIG. 1 but showing the engagement of the pressure roller with the printing plate as the printing cylinder rotates.
Figure 3:
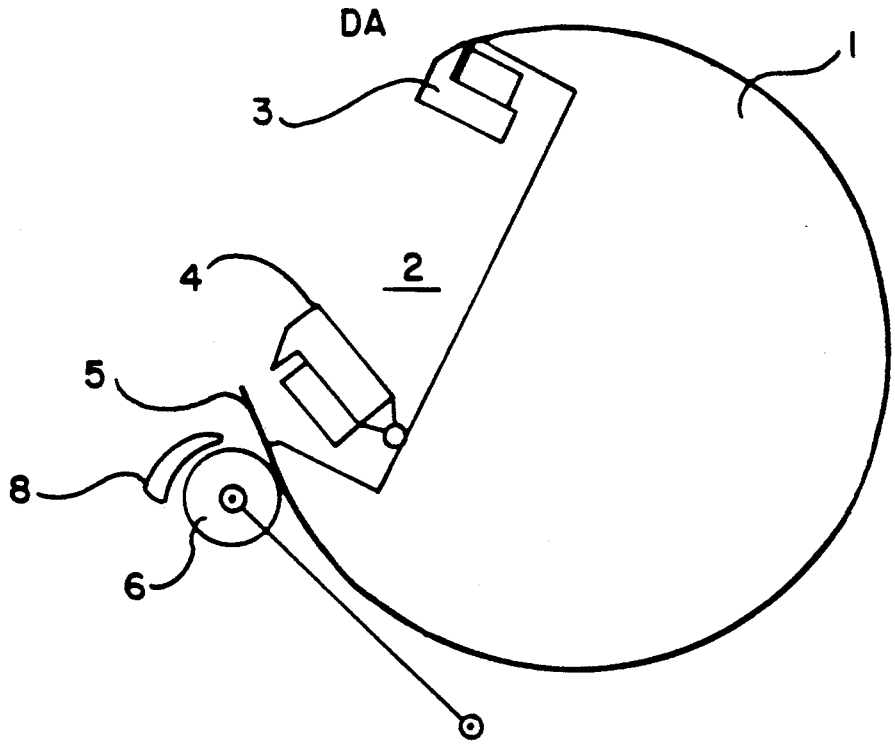
FIG. 3 is a schematic illustration similar to FIG. 1 but showing the printing plate wrapped around the printing cylinder as a result of the cylinder's rotation.
Figure 4:
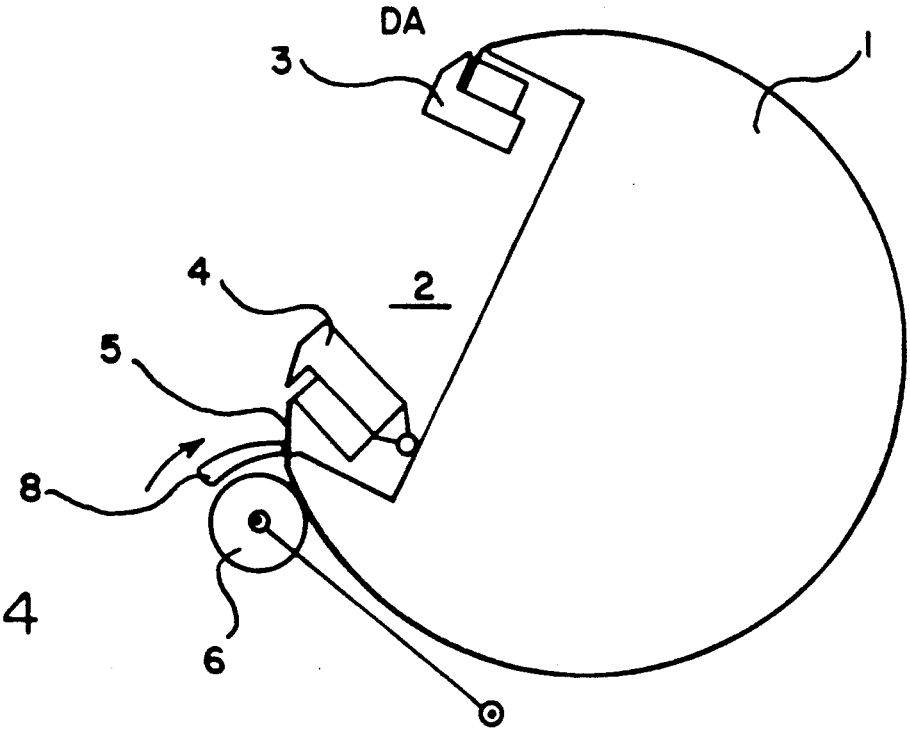
FIG. 4 is a schematic illustration similar to FIG. 1 but showing the folding strip bending the trailing edge of the printing plate for insertion into the print end tension rail.

FIGS. 1 to 4 illustrate a plate cylinder 1 with an elongated channel 2 that houses a front tension rail 3 which engages the leading or front edge of the printing plate and a rear tension rail 4 which engages the trailing edge of the printing plate. The tension rails 3, 4 comprise an upper and a lower clamping rail wherein the lower clamping rail is movable relative to the upper clamping rail in order to open and close a gripping region which secures the printing plate 5. Although the illustrated designs of the front and rear tension rail 3, 4 are one possible embodiment, it will be appreciated that any suitable tension rail known in the art may be substituted. The rear tension rail 4 is arranged pivotably in an elongated cylinder channel 2 and, as illustrated, with its gripping region in a completely open position. As illustrated in FIG. 4, when the rear tension rail 4 is pivoted in a direction toward the outer circumference of the plate cylinder, the trailing end region of a printing plate 5 can be introduced into the gripping region between the upper and lower clamping strip and subsequently clamped. Once the plate is securely clamped, the plate can be tensioned by pivoting the rear tension rail 4 in a direction toward the center of the plate cylinder.

Figure 1:
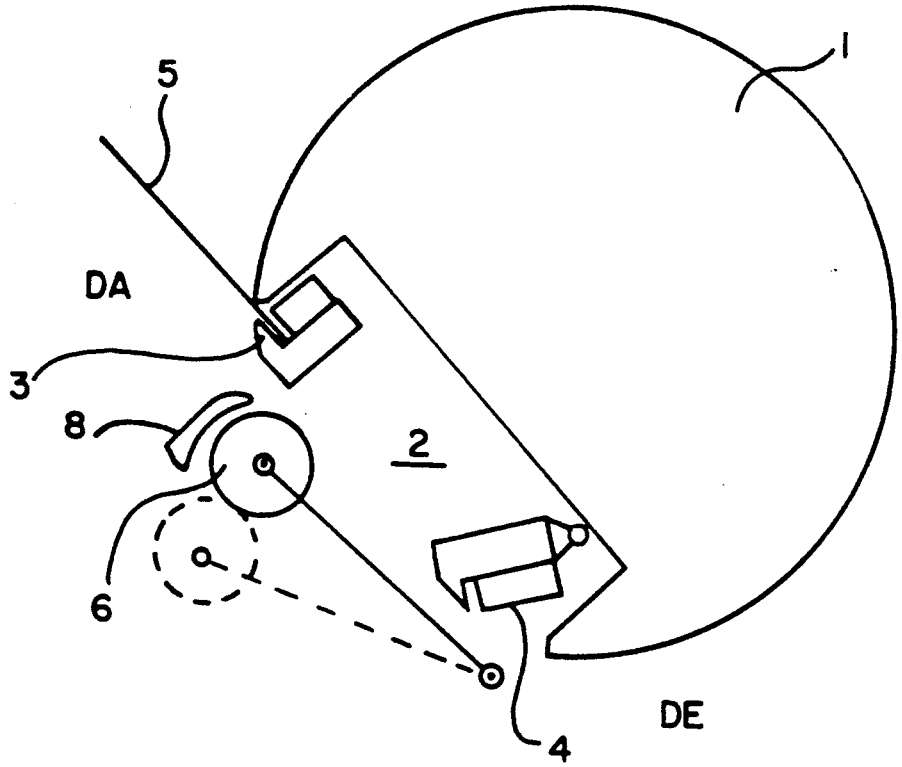
FIG. 1 is a schematic illustration of a printing plate being drawn onto a plate cylinder in accordance with the teachings of the invention showing the leading edge of a printing plate inserted in the print start tension rail.

To begin the drawing on procedure, the plate cylinder 1 is first placed in a position in which a printing plate 5 can be introduced into the open front tension rail 3 as best seen in FIG. 1. The front tension rail is then clamped. As best seen in FIG. 2, a pressure roller 6 which extends over the format width of the plate cylinder 1 and is mounted pivotably on both sides via bearing levers 7, is then pivoted into contact with the printing cylinder 1. In this position, the pressure roller 6 presses the printing plate 5 against the plate cylinder 1 as the plate cylinder 1 is rotated. (As represented in broken lines in FIG. 1, the pressure roller 6 can also be pivoted to a position away from the printing plate and plate cylinder when necessary.) The plate cylinder is then rotated in a forward direction, i.e. from the print start to the print end and the pressure roller 6 presses the printing plate 5 to the outer circumference of the printing cylinder 1.

As illustrated in FIG. 2, as the plate cylinder 1 is rotated, the pressure roller 6 first advances over the outer contour of the tension rail 3 and then, during further rotation, presses the printing plate 5 against the outer circumference of the plate cylinder 1. The forward rotation of the plate cylinder 1 is continued under the control of the printing-unit drive, until the pressure roller 6 comes to rest in the region of the print end DE of the plate cylinder 1. As illustrated in FIG. 3, once the plate cylinder has ceased rotation, the trailing end of the drawn-on printing plate 5 projects in a direction tangential to the plate cylinder 1.

As illustrated throughout FIGS. 1 to 4, a folding strip 8 is situated above the pressure roller and this folding strip 8 extends parallel to the axis of the pressure roller and, correspondingly, extends parallel to the axis of the plate cylinder. The folding strip 8 can be moved, by means described in more detail below from a position not in contact with the printing plate 1 as shown in FIGS. 1 through 3 to a position which bends the trailing end of the printing plate 5 as shown in FIG. 4.

Figure 5:
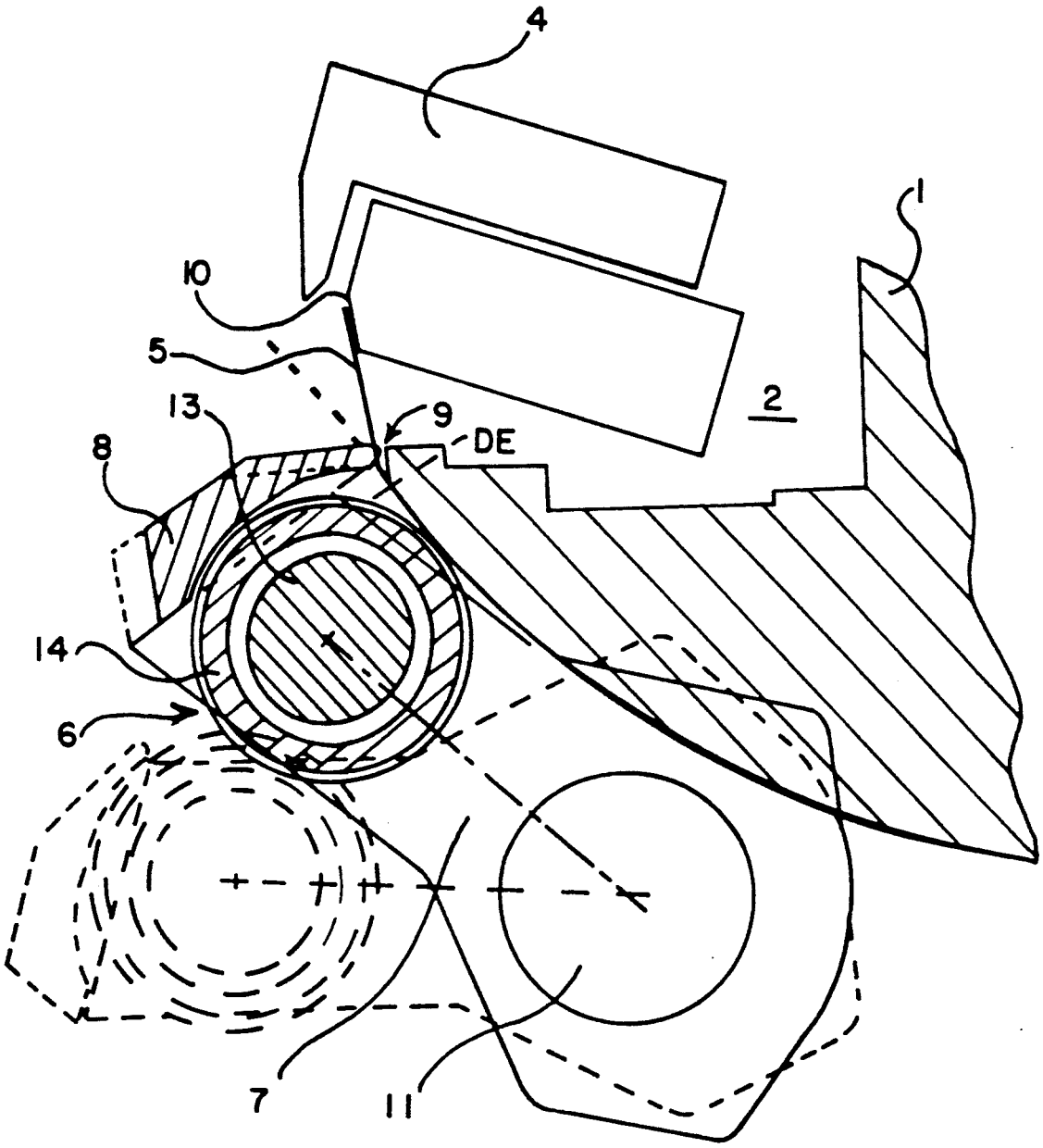
FIG. 5 is a fragmentary cross-sectional view of a portion of the plate cylinder, the pressure roller and the folding strip.

As illustrated in FIG. 5, the attachment and the mounting of the folding strip 8 relative to the pressure roller 6 or its bearing lever 7 is such that the printing plate 5, held in the region of the print end DE by the pressure roller 6, is bent around a bevel 9 of the plate cylinder 1 located on the print end DE thereby advantageously causing the trailing edge of the printing plate 5 to come to rest on a correspondingly shaped stop face 10 of the completely open tension rail 4 which, as shown, has been completely pivoted backwards i.e. in a direction opposite to the rotation direction of the plate cylinder 1. The stop face 10 on the rear tension rail 4, like the folding strip 8, extends over the entire format width of the plate cylinder 1.

Figure 7:
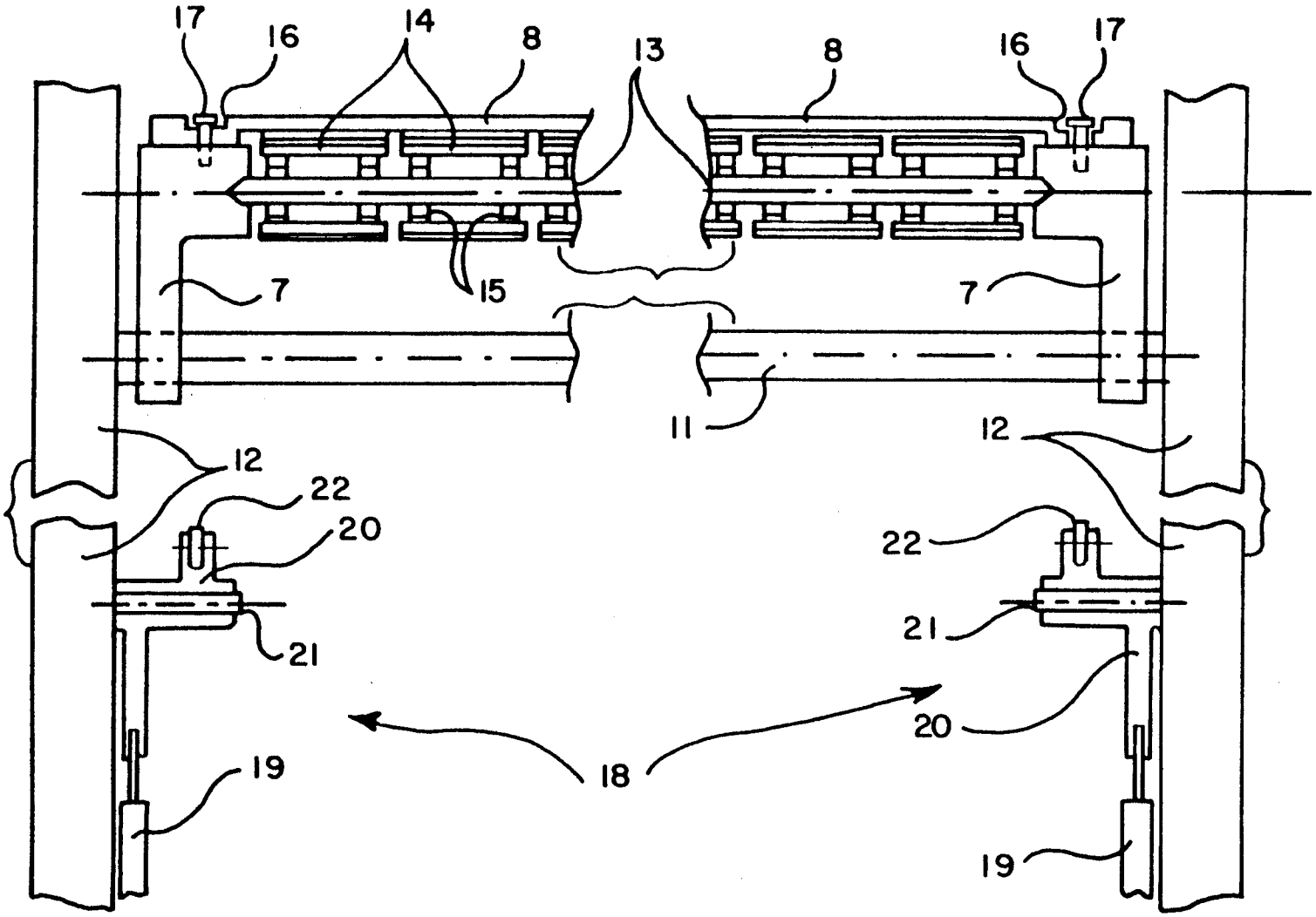
FIG. 7 is a fragmentary plan view of a mounting of the pressure roller and the folding strip; and, FIG. 8 is a fragmentary cross-sectional view of an alternative embodiment of the folding strip.

FIG. 7 illustrates in more detail the mounting of the pressure roller 6 and the folding strip 8 in addition to the curvature of the folding strip 8 in the effective region. The pressure roller 6 is fastened rotatably to each of two side stand walls 12 of the printing machine (not shown) at one end of a bearing lever 7. The pivot axis of the bearing levers 7 which are located on the stand can be formed, for example, by a cross-member 11, to which the run-in protection, not shown here, between the plate cylinder 1 and the rubber-blanket cylinder (not shown) is also attached (FIGS. 5 and 7).

One end of an axle 13 is fastened respectively to the two pivotable ends of the bearing lever 7. The pressure roller 6 is mounted rotatably on this axle 13. The pressure roller 6 is advantageously subdivided into individual portions, each portion consisting of a cylindrical sleeve 14 which is mounted respectively on the axle 13 via a plurality of radial bearings 15, i.e. needle bearings. The sleeves 14 have, for example, a rubber-like covering which possesses a degree of hardness of, for example, 50 Shore/A.

The subdivision of the pressure roller 6 into individual sleeves 14 compensates for the sag found between the pressure roller and the plate cylinder in undivided pressure rollers. In a large-format machine, compensating for this roller/cylinder sag may also be accomplished by again subdividing the pressure roller and bending the roller axle 13 in a direction towards the plate cylinder. Further measures for compensation of sag can also be provided.

The folding strip 8 is movably mounted relative to the bearing levers 7 in the two pivotable ends of the bearing lever 7, above the fastening region of the axle 13, via an elongated slot 16 and a screw 17. The direction of extension of the slot 16 corresponds to the direction in which the folding strip 8 is to move as viewed in FIGS. 3 to 5. The position of the folding strip 8 will default to a location in the slot 16 with respect to the lever 7 through the use of a spring means (not shown). This default position of the folding strip 8 is shown schematically in FIGS. 1 through 3.

In order that the folding strip 8 folds the printing plate 5 over the print end bevel 9 with as uniform a force as possible over the format width, the folding strip 8 can also be bent or designed with a curve in a direction forward to the tension rail. This bending should compensate for any sag between the folding strip and the tension rail. In addition, the folding strip 8 can also have a profiling which prevents sagging.

Piston rods, e.g. from double-acting compressed air working cylinders, coupled to the two bearing levers 7, provide the means for advancing the pressure roller 6 into a position to contact the plate cylinder 1. The pressure roller 6 can thus be pivoted between the positions shown in FIGS. 1 and 5 by the straight and broken lines. The force ratios of the working cylinders and the lever ratios of the articulation of the rods on the bearing levers 7 are such that the pressure roller 6 obtains the desired pressure force on the printing plate 5 relative to the plate cylinder 1. So that the pressure roller 6, does not over-advance or penetrate into the cylinder channel 2 of the plate cylinder 1 while the roller is being advanced to the contact position, positional limitation stops on the bearing levers 7 which are supported on the bearer rings of the plate cylinder may be installed. Further stops may also be provided on the bearing levers to prevent damage to the surface of the bearer rings.

Figure 6:
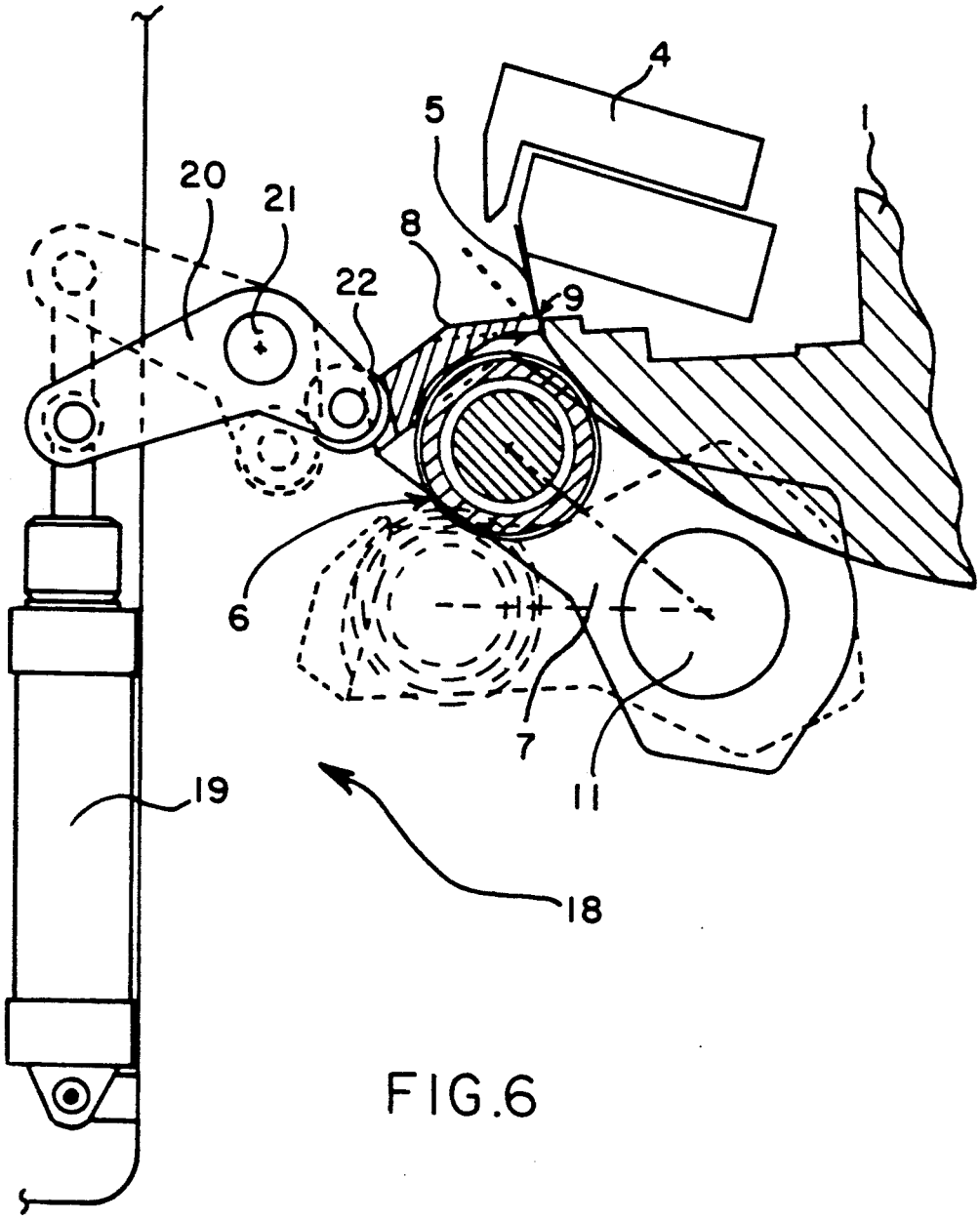
FIG. 6 is a fragmentary cross-sectional view, similar to FIG. 5 illustrating an actuating device for the folding strip.

FIGS. 6 and 7 illustrate the actuating device 18 of the folding strip 8. A double-acting working cylinder 19, i.e. of the compressed air type, is arranged on each of the two side stand walls 12 with the working cylinder's piston rod coupled to one arm of an angularly disposed double lever 20. The double levers 20 are each pivotably mounted on a side stand wall 12 about a respective pivot pin 21. The free ends of the double levers 20 each have a running roller 22, which acts upon the folding strip 8.

When the pressure roller is engaged with the plate cylinder 1, the angle of the double levers 20 and the placement point of the pivot pins 21 are selected so that the folding strip 8 will be displaced from its default position to a position which folds the printing plate 5 the desired amount when the fluid flow to the working cylinders 19 is switched. When the working cylinders are switched again, the folding strip returns to its default position. When the pressure roller 6 is not in contact with the plate cylinder 1, the double lever 20 is pivoted back by an angular amount sufficient so that the folding strip 8 experiences no obstruction by the running roller 22. In FIG. 6, the non-switched position of the double lever is shown by the dashed lines.

Figure 8:
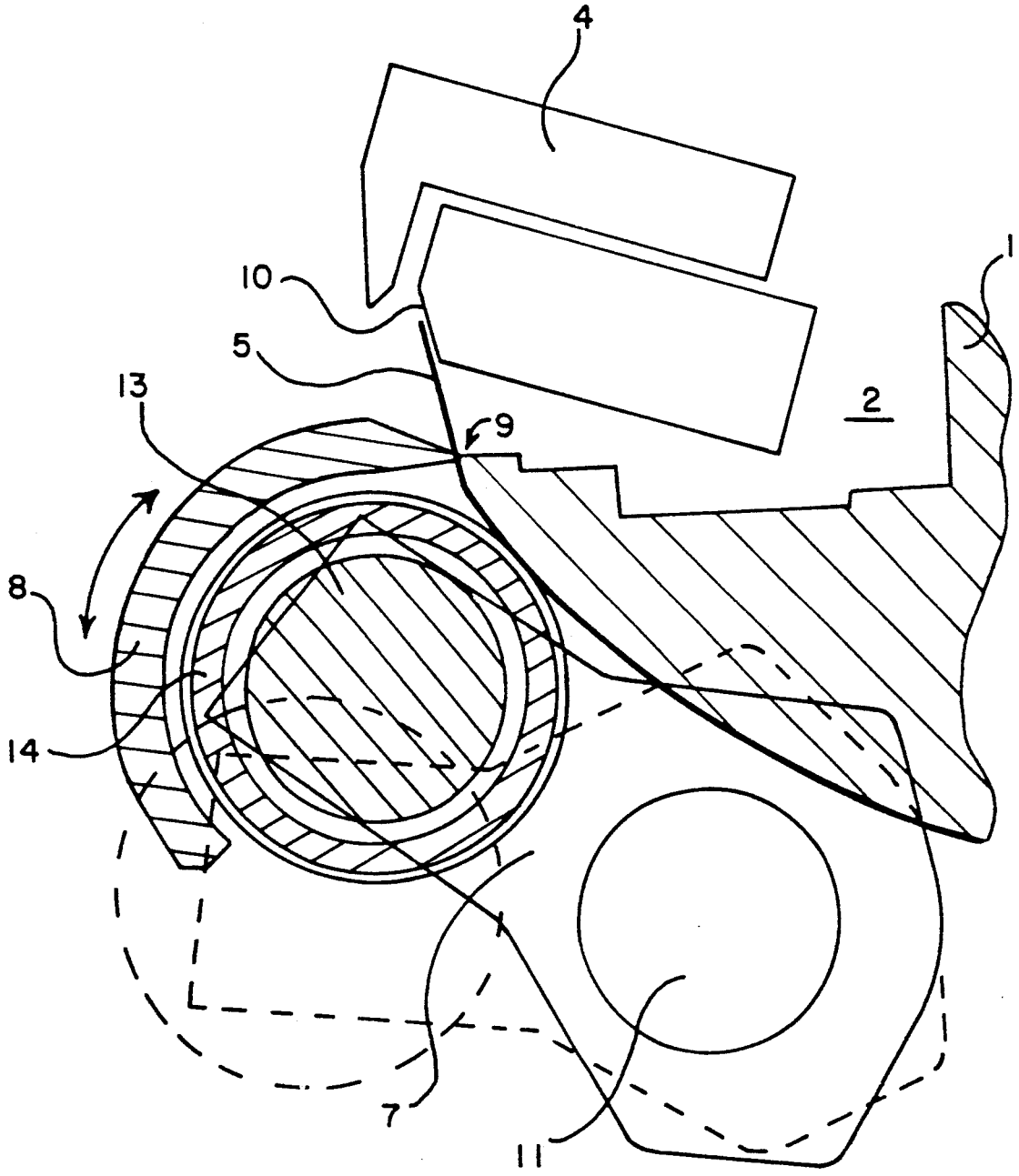

FIG. 8 illustrates an alternative and especially advantageous embodiment of a folding strip constructed in accordance with the invention. Here, the folding strip 8 has the arcuate profile of a tube segment which is rotatably mounted by a specific angular amount (arrow) about the axle 13 of the pressure roller 6. By means of this embodiment, the folding strip 8 (its end acting on the printing plate 5) can be attached very near to the pressure roller 6 and, furthermore, this embodiment reduces the sag possibility between the folding edge and the tension rails. A folding strip 8 designed in this way may be rotatably mounted about the axle 13, at least at its ends, through arms (not shown). This folding strip configuration, similar to the one above, is actuated through double levers 20 when the pressure roller 6 is engaged with the plate cylinder. A further advantage of such an embodiment is that the folding strip may act to protect the pressure roller 6 when the folding strip 8 is pivoted to its default position.

The folding strip 8 shown in profile in FIG. 8 can be alternatively mounted about the axle 13 via a plurality of arms guided through the axle 13 in the region of the sleeves 14 of the pressure roller 6 which would be axially spaced from one another. (Compare to FIG. 7) Such a multiple mounting of the folding strip 8 relative to the axle 13 would reinforce the pressure roller 6.

We claim as our invention:

1. A device for drawing and bending the trailing edge of a printing plate onto a plate cylinder of a sheet-fed rotary printing press wherein said plate cylinder includes an elongated channel disposed longitudinally in the periphery thereof for receiving and supporting means for gripping the leading edge of said printing plate adjacent the print start portion thereof and for receiving and supporting means for clamping and tensioning said trailing edge of said printing plate adjacent the print end portion thereof, said drawing and bending device comprising, in combination, means including a pressure roller engageable with said plate cylinder for drawing said printing plate around the outer periphery of said plate cylinder as said plate cylinder is rotated with said leading edge held by said gripping means, means including a folding strip disposed parallel to said pressure roller and in advance thereof with respect to the direction of rotation of said plate cylinder, means for mounting said folding strip for movement relative to said pressure roller and into engagement with said trailing edge of said printing plate, and actuating means for moving said folding strip relative to said pressure roller and into engagement with said trailing edge of said printing plate so as to bend said trailing edge inwardly with respect to said cylinder channel.

2. A drawing and bending device as defined in claim 1 wherein said pressure roller is journalled on a pair of levers mounted for pivotal movement toward and away from the periphery of said plate cylinder and said folding strip is mounted on said levers for movement relative to said pressure roller toward and away from the periphery of said plate cylinder.

3. A drawing and bending device as defined in claim 2 wherein said actuating means is disposed and arranged to move said folding strip only when said pressure roller is engaging said printing plate.

4. A drawing and bending device as defined in claim 3 wherein said actuating means includes at least one fluid operated actuator connected by one arm of a double arm lever to said folding strip.

5. A drawing and bending device as defined in claim 4 wherein the other arm of said double arm lever carries a running roller engageable with said folding strip.

6. A drawing and bending device as defined in claim 1 wherein said folding strip has a longitudinally convex profile facing said printing plate.

7. A drawing and bending device as defined in claim 2 wherein said mounting means for said folding strip includes a pin and slot connection between each end thereof and said levers.

8. A drawing and bending device as defined in claim 7 wherein said folding strip has a cross-section and a longitudinal profile formed to resist sagging and deflection between the ends thereof.

9. A drawing and bending device as defined in claim 1 wherein said folding strip has an arcuate cross-sectional shape and is mounted for partial rotational movement about said pressure roller.

10. A drawing and bending device as defined in claim 9 wherein said pressure roller has an axle and said folding strip is rotatably supported on said axle by at least two mounting members adjacent the ends of said folding strip.

11. A drawing and bending device as defined in claim 1 wherein said cylinder channel is formed with a beveled entrance portion adjacent the print end side thereof and said folding strip is operative to bend said trailing edge of said printing plate against said beveled entrance portion.

12. A drawing and bending device as defined in claim 11 wherein said clamping and tensioning means in said cylinder channel includes at least two parts movable relative to one another to define a gap for receiving said trailing edge of said printing plate therein and said folding strip is operative to bend said trailing edge into alignment with said gap.

* * * * *